US006792407B2

(12) United States Patent
Kibre et al.

(10) Patent No.: US 6,792,407 B2
(45) Date of Patent: Sep. 14, 2004

(54) TEXT SELECTION AND RECORDING BY FEEDBACK AND ADAPTATION FOR DEVELOPMENT OF PERSONALIZED TEXT-TO-SPEECH SYSTEMS

(75) Inventors: Nicholas Kibre, Mountain View, CA (US); Steven Pearson, Santa Barbara, CA (US); Brian Hanson, Goleta, CA (US); Jean-Claude Junqua, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 510 days.

(21) Appl. No.: 09/821,973

(22) Filed: Mar. 30, 2001

(65) Prior Publication Data

US 2002/0193994 A1 Dec. 19, 2002

(51) Int. Cl.[7] ..... G10L 13/06
(52) U.S. Cl. ..... 704/260
(58) Field of Search ..... 704/231, 246, 704/275, 258, 260, 266

(56) References Cited

U.S. PATENT DOCUMENTS

| | | | | |
|---|---|---|---|---|
| 4,624,012 A | | 11/1986 | Lin et al. | |
| 5,278,943 A | | 1/1994 | Gasper et al. | |
| 5,684,927 A | | 11/1997 | Mirkowicz | |
| 5,696,879 A | | 12/1997 | Cline et al. | |
| 5,933,805 A | | 8/1999 | Boss et al. | |
| 5,970,453 A | | 10/1999 | Sharman | |
| 6,038,533 A | | 3/2000 | Buchsbaum et al. | |
| 6,078,885 A | * | 6/2000 | Beutnagel | 704/258 |
| 6,266,637 B1 | * | 7/2001 | Donovan et al. | 704/258 |

OTHER PUBLICATIONS

Campbell et al.; "CHATR: A Multi–Lingual Speech Re–Sequencing Synthesis System"; in Proc. of Institute of Electronic Information and Communication Engineers–89, Tokyo, Japan; pp. 45–52, English Abstract.

* cited by examiner

*Primary Examiner*—Susan McFadden
(74) *Attorney, Agent, or Firm*—Harness, Dickey & Pierce, PLC

(57) ABSTRACT

A new speaker provides speech from which comparison snippets are extracted. The comparison snippets are compared with initial snippets stored in a recorded snippet database that is associated with a concatenative synthesizer. The comparison of the snippets to the initial snippets produces required sound units. A greedy selection algorithm is performed with the required sound units for identifying the smallest subset of the input text that contains all of the text for the new speaker to read. The new speaker then reads the optimally selected text and sound units are extracted from the human speech such that the recorded snippet database is modified and the speech synthesized adopts the voice quality and characteristics of the new speaker.

17 Claims, 3 Drawing Sheets

TEXT SELECTION AND RECORDING BY FEEDBACK AND ADAPTATION FOR DEVELOPMENT OF PERSONALIZED TEXT-TO-SPEECH SYSTEMS

BACKGROUND AND SUMMARY OF THE INVENTION

The present invention relates generally to text-to-speech synthesis. More particularly, the invention relates to a method for personalizing a synthesizer and for developing a database of speech units for use by a text-to-speech synthesizer.

Text-to-speech synthesis systems convert an input string of text into synthesized speech using speech modeling parameters or digitally sampled concatenative sound units to generate data strings that are played back through an audio system to mimic the sound of human speech. The model parameters or concatenative units are usually developed or trained in advance using recordings of actual human speech as the starting point. The model parameters or concatenative units, however, allow a very limited mimic of the sound of human speech based on the training which typically utilizes recordings from one individual.

Developing a sufficiently rich body of spoken text can be very time-consuming and expensive. Examples of actual human speech need to be recorded and labeled; and the resulting set of recordings needs to include at least one instance of every speech unit type needed for synthesis of all attested phoneme strings in the target language. This means, for example, that in a diphone synthesizer, the database must contain recorded examples of every allowed sequence of two allophones. Because data collection and analysis involves significant labor, it is desirable to minimize the size of the database. Ideally this means that one wants to collect the smallest set of utterances containing the desired material. However, in planning the recording sessions it is also necessary to consider other factors. Many unit types may contain different pronunciations, based on phonemes adjacent to the ones they contain. If the resulting synthesizer is to reproduce these effects, then all such variants must be attested.

For example, in the English language the diphone sequence /kae/ is pronounced differently in "cat" than in "can", due to the nasalizing effects of the following /n/ in the latter word. A high quality synthesizer must contain examples of both types of /kae/.

In addition to variations due to adjacent phonemes, other variations may be attributed to syllable boundaries and word boundaries. Moreover, some contexts may simply produce better sound units than others. For example, sound units taken from secondary stressed syllables can be used to synthesize both secondary and primary stressed syllables. The converse is not necessarily true. Thus sound units taken from context which have primary stress in the original utterance may only be useable for synthesizing syllables which also have primary stress. Finally, synthesis developers may find that certain types of utterances produce better sound units than others. For example, when human speakers read simple words in isolation, the recordings often do not produce good sound units for synthesis. Similarly, very long sentences may also be problematic. Therefore complex words and short phrases are preferred.

The task of assembling a collection of suitable text words and phrases for use in a synthesis database recording session has heretofore been daunting, to say the least. Most developers will compile a collection of sentences and words for the preselected speakers to read and this collection is usually quite a bit larger than would actually be needed if one analyzed the text requirements in a systematic way. The result of collecting suitable text words and phrases based on preselected speakers is a limited ability to produce the synthesized speech. Although the synthesized speech mimics the sound of human speech, the range of qualities of the sound is limited to a great extent depending on the speakers. Most synthesis system designers have approached the problem more as an art than as a science and that yields a limited ability to produce mimicked speech personalized to sound similar to a particular human.

The present invention seeks to formalize the development of recorded content for text-to-speech synthesis through a set of procedures which, if followed, produce a minimal recording text list which contains all necessary unit types for a given language, with all desired variants of each, from optimal contexts in optimal types of utterances. The invention further seeks to personalize the synthesized speech to more closely mimic a particular speaker based on the minimal recording text list.

The personalizer represents one important aspect of the invention in which an original set of recorded sound units, stored as allophones, diphones and/or triphones (generally referred to here as snippets) in a database, are compared with the sound units of a new speaker or target speaker. In a preferred embodiment, allophones from different contexts are compared with allophones from the original set of recorded sound units. This is done by acoustic alignment of the respective allophones, followed by a closeness comparison. The closeness comparison may be performed using the same components as are used for automatic speech recognition.

When the comparison is performed, some allophones from the recorded set and from the new speaker will be sufficiently close, acoustically, so that no modification of those allophones is required. However, other allophones may differ substantially between the originally recorded set and the new target speaker. The personalizer employs a threshold comparison system to separate the allophones that are acoustically close from those that are not. The personalizer then focuses on the allophones that are not acoustically close. These "far" allophones will be altered to make the synthesizer sound more like the target speaker.

The set of "far" allophones can be compared against a source of text using an exhaustive search algorithm, to identify all passages of text that contain representative examples of the "far" allophones. However, the presently preferred embodiment uses a greedy selection algorithm to identify passages of text that best represent the "far" allophones. The greedy selection algorithm thus generates a customized training text which the target speaker then reads while the system captures examples of that speaker's "far" allophones. Once examples of the "far" allophones have been collected, they are substituted for those of the original set, or are otherwise used to transform the sound units used by the synthesizer, so that the synthesizer will now sound like the target speaker.

The target speaker utters each allophone in a given context, such as a neutral context (e.g. the vowel surrounded by letters 't' or 's'). Using knowledge of the target speaker's allophones in this given context, the system determines which allophones are "far" from those of the synthesizer. While it is possible to simply substitute these known "far" allophones for those of the synthesizer, there typically will remain many other contexts of that allophone for which the system has no uttered data from the target speaker. Therefore, to develop a richer representation of the target speaker's allophones, the system determines what additional contexts or environments are needed to develop a complete assessment of the allophone in question and generates additional text for the target speaker to read. The generated text is specifically designed using the greedy algorithm to optimally obtain examples of the allophones in question from other contexts. In this way the "far" allophones may be pulled closer to those of the target speaker across all contexts.

The additional contexts are selected by rules designed to group or cluster contexts into related classes. In designing the system, related classes of contexts are determined by analyzing the data from the original synthesizer and then making the assumption that all speakers (including the target speaker) would have the same classes. For example, the data may show that the letter 'a' in the context of adjacent fricatives will all behave in acoustically the same way and would thus be clustered together. To do this a closeness metric may be applied, such as the closeness metric defined for triphones in developing the original synthesizer. Such a metric would "reach over" the vowels and thus "sense" the context influence. This information would be used to cluster vowels into groups that are influenced in similar ways by a given context.

Although the preferred embodiment originally collects neutral context allophones from the target speaker, the final synthesizer product may be based on snippets comprising sound units of different sizes, including diphones, triphones and allophones in various contexts. In theory, the neutral context allophones of the target speaker that are sufficiently close to the original synthesizer do not have to be trained further. The same holds true for larger sound units such as diphones and triphones that contain these "close" allophones. On the other hand, when neutral context allophones are discovered to be "far," related larger sound units such as diphones and triphones will also need to be corrected. The text generated by the greedy algorithm elicits speech from the target speaker to improve these larger sound units as well.

The personalization process can be performed once as described above, or many times through iteration. In the iterative approach, the target speaker reads the generated text, allophones are extracted from this speech and then processed and used to modify the synthesizer and to generate new text for reading. Then the target speaker provides additional speech samples from the new text, and a closeness comparison is again performed, and further text is generated. Each time the target speaker reads the generated text, the synthesizer and its set of sound units are more closely tuned to that speaker's speech. The process proceeds iteratively until there are no longer any "far" allophones when the closeness comparison is performed.

While implementation may vary, the presently preferred system employs a lexicon compiler/analyzer, a parser, a phoneme-to-unit utility, a closeness comparator, a required snippets selector and an optimal set selection algorithm. The lexicon compiler/analyzer produces a database of phonetically analyzed words, with their corresponding phoneme strings, including prosodic boundaries (syllable boundaries plus the stronger boundaries which occur between elements of complex words). The parser extracts phrases suitable for recording from text corpora. The phoneme-to-unit utility determines which sound units (i.e. snippets) can be extracted from a recording of each word or phrase, and what context features each would have. The phoneme-to-unit utility marks any snippets which occur in environments which make them unsuitable as sources for the speech unit database. The closeness comparator determines required snippets based on snippets selected from the text database and allophones obtained from a new speaker. The required snippets are useful in providing voice personalized data so that a unique human sound may be synthesized based on a particular user. The set selector examines the inventory of words and phrases analyzed by the preceding modules and determines a minimal subset which can contain a desired number of tokens for each unit type (defined in terms of phonemes contained in the unit as well as context features applied to them) in optimal environments. The above described modules can be implemented to perform an exhaustive search, by a greedy algorithm, or by other appropriate means.

The greedy selection algorithm used in the above personalizer may also be used upon acoustically labeled previously recorded speech, such as from transcribed speeches, books on tape, closed caption broadcasts, and the like, to generate new synthesizers or synthesizers that sound like the recorded speech. Examples of acoustically labeled recorded speech may be obtained via broadcast media or over the internet. The algorithm identifies the best or most reliable examples of recorded speech—those that will best represent each allophone in context. Once these allophones are identified, they may be analyzed to extract source-filter synthesis model components to construct a synthesizer. Thus, for example the identified allophones may be analyzed to extract the formant trajectories and glottal pulse information, which is then used to develop the new synthesizer.

For a more complete understanding of the invention, its objects and advantages, refer to the following specification and to the accompanying drawings.

DESCRIPTION OF THE PREFERRED EMBODIMENT

Figure 1:
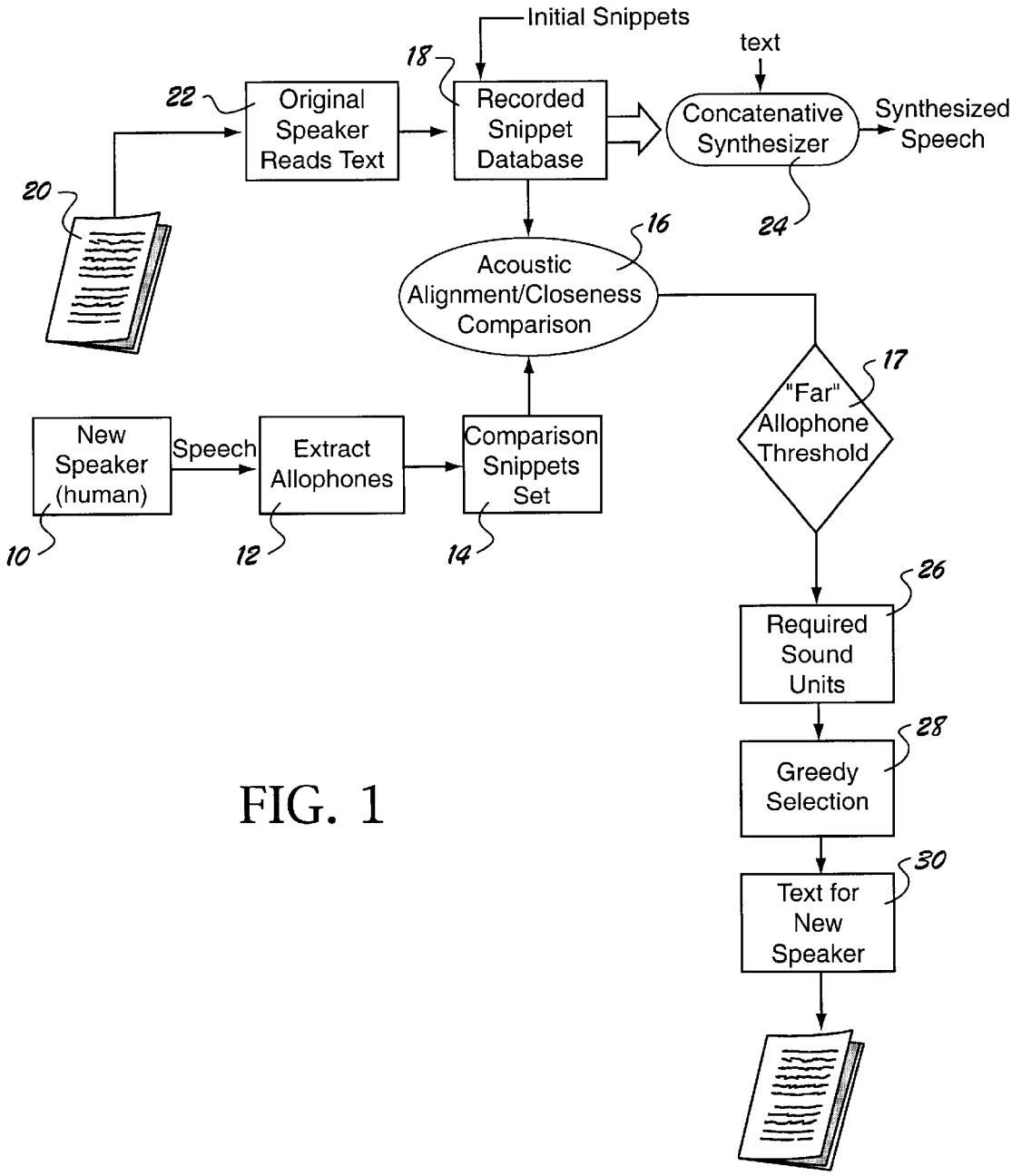
FIG. 1 is a flowchart diagram illustrating the presently preferred voice quality adaptation technique.

Referring to FIG. 1, the presently preferred synthesis personalizer system is illustrated. This system compares acoustic characteristics of stored sound units from a concatenative synthesizer to acoustic characteristics of a new target speaker, and assembles an optimal set of text which the new speaker then reads. The text selected for a new speaker to read is then used with the synthesizer to adapt to the voice quality and characteristic particular to the new speaker.

Referring to FIG. 1, the concatenative synthesizer 24 used includes a recorded snippet database 18. The recorded snippet database has initially recorded snippets that produce speech, but with a single voice quality based on an original speaker or group of speakers.

The personalizer will analyze speech uttered by a new target speaker 10. The speech is then used to extract allophones or other acoustic characteristics so that snippets 14 are available. Snippets 14 are acoustically aligned and compared at 16 with snippets obtained from a recorded snippet database 18 associated with a concatenative synthesizer.

The closeness comparison performed at 16 is preferably accomplished using automated speech recognition components that compare closeness as a byproduct of recognition typically or on the basis of spectral criteria (e.g., formants, amplitude, etc.) ignoring irrelevant temporal variations in the compared sound units. In most cases some of the new target speaker's snippets will resemble those in the database 18 and other snippets will not. A closeness threshold is applied at 17 to identify those "far" snippets of the new speaker that do not resemble those stored within database 18. These "far" snippets become the required sound units 26 that the personalizer system will attempt to improve. This is accomplished using a greedy selection algorithm 28 that selects optimal examples of text 30 that the new speaker then reads. From the newly read text, the relevant allophones of the new speaker are extracted and used, through substitution or transformation, to alter the recorded snippets in database 18 so that they sound more like the target speaker.

The details of the greedy selection algorithm are provided at the end of this written specification. Some presently preferred techniques for modifying the recorded snippets of database 18 are also shown and described in connection with FIG. 3. However, before presenting a discussion of these aspects, the following will address the presently preferred manner of developing the recorded snippet database 18. An understanding of this development is useful in understanding the greedy selection algorithm and the personalizer of the invention.

Figure 2:
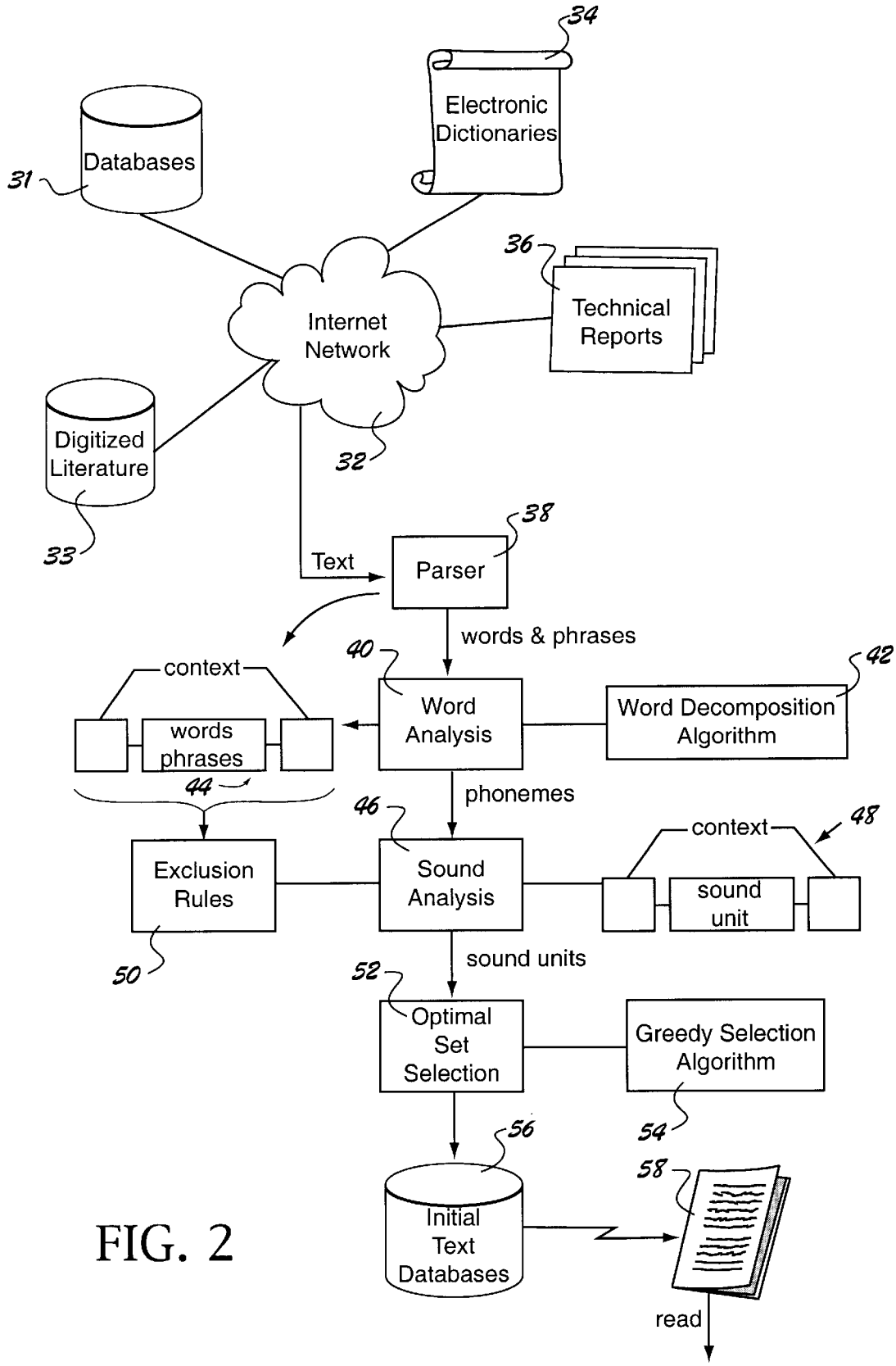
FIG. 2 is a flowchart diagram illustrating a text selection technique for use with voice quality adaptation of FIG. 1.

Recorded snippet database 18 associated with concatenative synthesizer 24 is based on text 20 and is preferably acquired from a preferred text selection technique further described in FIG. 2. An original speaker 22 reads text 20 which is provided to and stored in recorded snippet database 18. One preferred synthesizer is of the concatenative type. Concatenative synthesizer 24 is able to produce synthesized speech from text using the snippets from the recorded snippet database 18. The synthesized speech is characterized by a limited voice quality based on the original speaker; however, the voice quality may be adapted such that the synthesized speech mimics a new speaker or user.

Recorded snippet database 18 provides recorded snippets which are compared at 16 with snippets 14. The comparison provides required sound units 26 which are identified as uniquely necessary for producing a set of snippets which are representative of the new speaker's voice and may be used to adapt the voice quality of the speech produced by concatenative synthesizer 24. Required sound units are further processed based on the required snippets so that an optimal set of new recording text is produced. Preferably, a greedy selection algorithm 28 identifies optimal text as the smallest subset of text that contains all of the sound unit types needed to represent the required sound units 26. Greedy selection algorithm 28 provides output, the set of words and phrases identified as optimal, as text for new speaker 30. New speaker 10 then may read the words and phrases to adapt concatenative synthesizer 24.

Referring to FIG. 2, the text selection system is illustrated. The text selection system analyzes text from a variety of sources and assembles an optimal text set that may then be read by human speakers. The human speech is then labeled according to the text that was read and the individual sound units are then extracted from the recorded speech for use in constructing a recorded snippet database associated with text-to-speech synthesizers.

The text selection system can analyze any source of text that is readable by computer. Accordingly, the Internet or network 32 can be used to identify and download text from a variety of sources including databases 31, electronic dictionaries 34, digitized works of literature 33, technical reports 36 and the like.

The text fed through a parser 38 that breaks the text into individual words and phrases. The parser examines the whitespace between words and the punctuation to identify individual words and phrases within the input text. In addition, the parser can also include a set of grammatical rules to allow it to identify phrases based on parts of speech, such as noun phrases and the like.

The output of parser 38 is fed to a word analysis module 40 that employs either a lexicon or a word decomposition algorithm 42 to break up the words and phrases into their constituent phonemes. The word decomposition algorithm performs its task by examining the individual letters in each word and phrase to identify vowels and consonants. The word analysis process considers not only a single letter but also its neighboring letters to determine what the correct phoneme assignment should be.

As the word analysis module 40 is performing its word decomposition algorithm, it also inserts flags associated with certain words and phrases based on the context of where that word or phrase appears in the entire sentence. This is done so that later processes can exclude sound units derived from the flagged words and phrases, or so those sound units can be used for special purposes. The reason for this has to do with the way human speakers read text when it is presented in sentence form. A human speaker will sometimes pronounce words at the beginning and end of a sentence differently than he or she would pronounce those words if they had appeared in the middle of the sentence. Because there can be more variation in the pronunciation of words in these sentence locations, the system is designed to exclude those words from being used to develop the optimal text set. Thus parser 38 and word analysis module 40 make a record of the context of the words and phrases as they appear in the sentence. This is depicted diagrammatically at 44.

Once the phonemes have been extracted from the words and phrases, they are supplied to a sound analysis module 46 to identify the constituent sound units found within the generated phonemes. The sound analysis module uses phoneme information to identify the sound units. The ultimate constitution of the sound units will depend on the nature of the synthesizer. For example, the synthesizer may use syllables, demi-syllables, pairs of half syllables, or the like. The sound analysis module takes the phonemes and identifies how they may be grouped into the sound units of choice. In doing so, sound analysis module 46 also keeps track of the context of the sound units. That is, the sound analysis module identifies not only the sound unit, but also its neighboring sound units. This is done so that the system will flag text where particular sound units may be colored by the pronunciation effects of their neighboring sound units. Thus sound analysis module 46 stores sound units in a data structure that also maintains a record of phonetically important neighboring sound units, as illustrated diagrammatically at 48.

The sound analysis module 46 has a set of exclusion rules 50 whereby certain sound units are excluded from contributing to the final text database. The exclusion rules rely on the context information 44 generated by the parser 38 and word analysis module 40. The sound analysis module uses its exclusion rules to avoid words or phrases that lie at certain locations within the sentence (e.g., beginning or end). In a preferred embodiment the exclusion rules also reject accented syllables, because such syllables tend to provide lower quality sound units for the text-to-speech synthesizer.

Depending on the quantity of input text provided to parser 38, there could be numerous examples of words containing the desired sound units. While it would be possible to use all of the identified words—resulting in a certain degree of redundancy—the most cost effective text database is one where the human speakers can accomplish their reading task in the shortest amount of time. Thus the system employs an optimal set selection module 52 that uses a greedy selection algorithm 54 to identify the smallest subset of text that contains all of the unit types needed to represent the entire text-to-speech system database. The optimal set selection module stores its output, the set of words and phrases identified as optimal, in an initial text database 56 from which on-screen displays or printed displays 58 may be generated. The initial human speakers will then read the words and phrases on display 58 while his or her speech is being captured and digitized. The digitized speech is then correlated to the words and phrases in an initial text database 56, whereupon the digitized speech can be broken down into the desired sound units for storage and use by the text-to-speech synthesizer.

Figure 3:
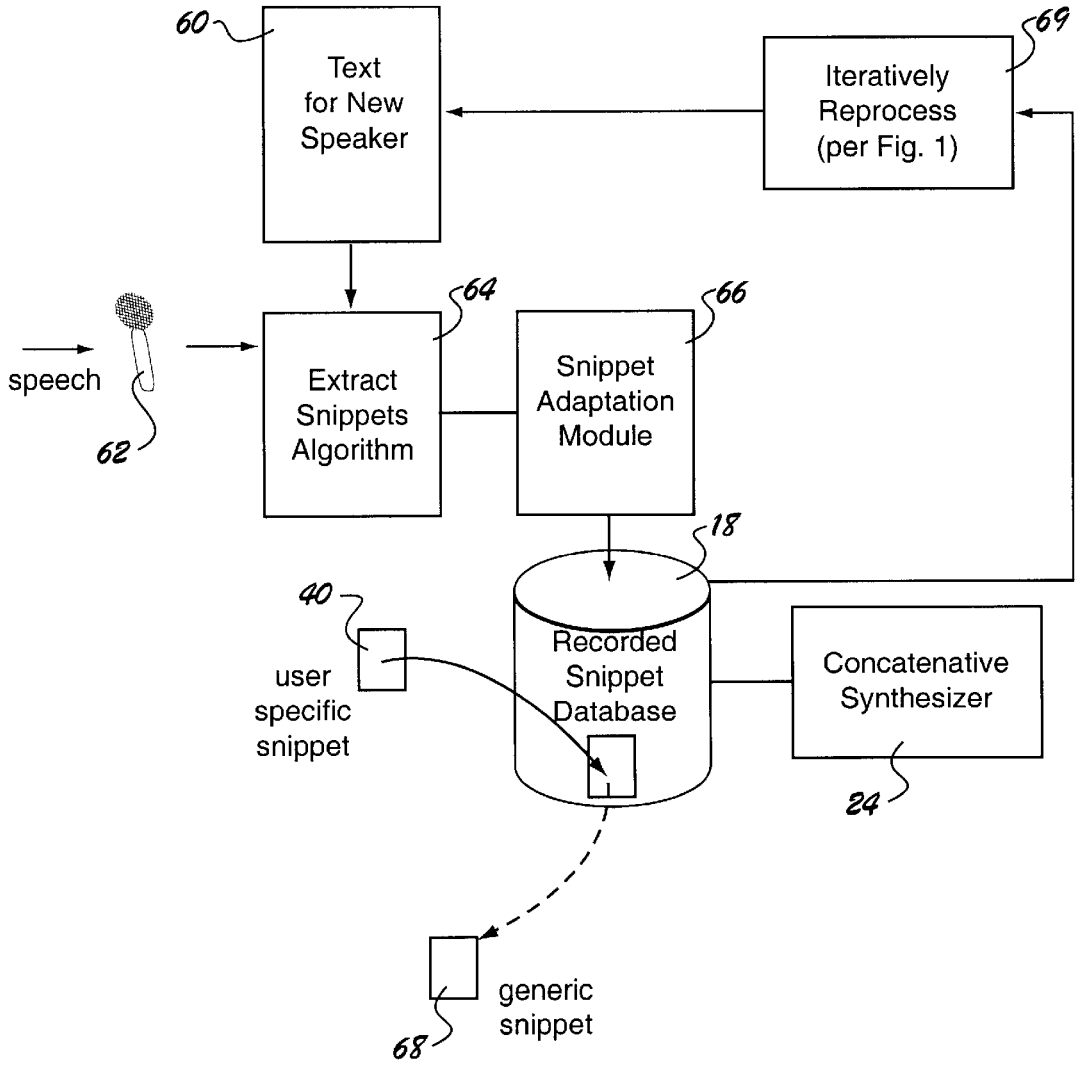
FIG. 3 is a flowchart diagram illustrating text-to-speech synthesis using the voice quality adaptation technique of FIG. 1.

Referring to FIG. 3, the concatenative text-to-speech (TTS) synthesizer 24 is personalized to mimic the voice quality of the new speaker. Text for the new speaker 60 is provided using the techniques described in FIG. 1. To initiate the text selection process, we start in FIG. 1 with the new speaker reading a text containing least one instance of each allophone to compare with those derived from snippets in the original database. As there are usually a small number of allophones in a language (e.g. we use about 70 for English), these initial allophone samples can be obtained by having the speaker read a very small list of sentences. This new speaker allophone set then provides a set of "snippets" for the initial comparisons at 16. A microphone 62 or other suitable transducer captures the new speaker's speech utterances. The acoustic characteristics of the speech utterances are then processed by extraction algorithm 64 to extract the relevant synthesis parameters or sound units. For example, the speech utterances may be acoustically aligned with the provided text and the individual allophones then used as snippets (for comparative purposes). The snippets may be stored as samples of digitized recorded speech, or they may be parameterized. In a presently preferred embodiment, the speech snippets are decomposed into their formant trajectories and glottal source pulses and these are parameterized.

Once the new speaker's utterances have been processed by algorithm 64 they are used by the snippet adaptation module 66 to modify what is stored in the snippet database 18. Depending on how the snippets have been represented (e.g., as recorded sound data or as parameters) the extracted snippet information is used to transform or replace corresponding records within database 18. Thus, as diagrammatically illustrated, a user-specific snippet 40 replaces or modifies the originally stored, generic snippet 68, thereby making the synthesizer sound more like the new speaker.

If desired, the above process can be performed iteratively, as illustrated at 69. Thus the recorded snippet database 18, after being modified by user-specific snippets, is then used while the process illustrated in FIG. 1 is repeated. Each time the new speaker provides additional examples of his or her speech, the closeness comparison step 16 assesses whether there are any remaining "far" allophones to be corrected. The procedure thus iterates, each time further improving the allophones represented in database 18 until all "far" allophones have been replaced or modified.

The Greedy Selection Algorithm

The presently preferred embodiments use a greedy selection algorithm to identify optimal sets of text that the training speaker(s) and personalizing target speaker read to develop the recorded snippet database. The details of the algorithm are shown in the pseudocode listing below at the end of this specification.

In addition to generating text for speakers to read aloud, the above greedy selection algorithm may also be used to process prerecorded speech that is accompanied by a corresponding text. For example, a prepared speech, or books-on-tape recording may be used as source material comprising both the recorded speech information and the corresponding text associated with that speech. The greedy selection algorithm identifies the best or most reliable examples of this recorded speech—those examples that will best represent each allophone in context. Once these allophones are identified, they are analyzed to extract the sound units or parameters used by a specific synthesis model.

For example, using a source-filter synthesis model to construct a synthesizer, the allophones identified by the selection algorithm are analyzed to extract the formant trajectories and glottal pulse information. This information is then used to develop the new synthesizer. Of course other types of synthesis models are also available. These may also be used with the greedy selection algorithm to construct synthesizers from prerecorded texts.

Pseudocode for Greedy Algorithm

PARSNIP

```
/* SET UP ARRAY OF PHONEME NAME STRINGS */
void prepphonstr (void )
/* DO ONE WORD */
void dostring ( char *s )
/* DO A FILE. EACH LINE ONE UTTERANCE (e.g., noun phrase) IN ORTHOGRAPHIC FORM
AND PHONEMES,
 * WITH THE TWO FIELDS SEPARATED BY SPACE */
void dofile ( char *fn )
        FILE * fp;
        char line [256], orth[256], phon [256];
void dohcfile (char *fn )
{
```

-continued

```
        FILE *fp;
        char line [256], phons [256];
}
/* PARSE A STRING OF PHONEMES WRITTEN TOGETHER,
 * AND FILL THE PHONEME ARRAY. ARRAY SHOULD START AND STOP WITH
 * SILENCE PHONEMES */
void figphons (char *cp )
{
        int phonctr;
        int longestmatch;
    /* INITIALIZE PHON ARRAY */
    for ( phonctr = 0; phoncrt <256; ++phonctr )
        phons [phonctr].str = phons [phonctr.bnd = phons[phonctr].cut = false;
/* ALWAYS START WITH A SILENCE PHONEME; WORD BND BETW IT &1ST REAL PHON
*/
/* GET PHONEMES FROM STRING */
for ( np =1; *cp; )
/* SEARCH LIST OF PHONEME TYPE STRINGS FOR ONES THAT MATCH
 * CURRENT POSITION OF WORD STRING */
for( phonctr=0, longestmatch=NOVAL; phonctr<NUMPHONTYPES; ++phonctr )
        if( !strncasecmp ( cp, phonstr [phonctr], strlen (phonstr [phonctr] ) ) )
/* END WITH A SILENCE PHONEME, WRD BND BETWEEN IT AND LAST REAL PHON */
        phons[np].type = SIL;
        phons[np++].bnd = 2;
/* FIGURE OUT WHICH PHONEMES CONTAIN SNIP BOUNDARIES */
void cutsnips ( void )
/* DETERMINE WHETHER A CONSONANT-CONSONANT SEQUENCE SHOULD BE SPLIT */
BOOL splitclust ( int p, BOOL onset )
        /* FOR RHYME AND HETEROSYLLABIC CLUSTERS, APPLY THE FLWG RULES IN
        ORDER */
        /* SPLIT ANY CLUSTER SPANNING A SYLLABLE BOUNDARY */
        /* NEVER SPLIT A HOMORGANIC NASAL+STOP SEQUENCE:
         * 13mar00: now ok to split nasal+stop cluster */
        /* SPLIT A C-C SEQUENCE WHERE THE FIRST C IS AN OBSTRUENT */
/* SHOULD CURRENT SNIP AND NEXT ONE GO TOGETHER */
BOOL doublesnip ( int p )
{
        /* LEGIT TO ASK THIS QUESTION? CUR PHON MUST BE IN LEGAL RANGE,
         * AND MUST BE AT A CUT POINT */
        /* SNIPS OVERLAPPING OVER SCHWA CAN BE DOUBLE SNIPS.
         * WE ONLY WANT CONSONANT-SCHWA-CONSONANT DOUBLE SNIPS, THOUGH
*/
        /* HOMORGANIC NASAL-STOP CLUSTERS CAN BE DOUBLE SNIPS TOO, IF NO
         * SYLLABLE BOUNDARY INTERVENES */
        /* SNIPS OVERLAPPING AT GLOTTAL STOP MUST BE DOUBLE SNIPS */
/* SEE IF A VOICELESS STOP PHONEME IS STRONGLY ASPIRATED (RETURN 1),
 * OR PRECEDED BY A SIBILANT AND THUS TOTALLY UNASPIRATED (RETURN -1);
 * OTHERWISE RETURN 0 */
/* ASPIRATION ONLY MATTERS FOR UNVOICED PLOSIVES */
/* IS THIS UNV PLO AT THE BEGINNING OF A STRESSED SYLLABLE? */
/* IS THIS UNV PLO WORD INITIAL? */
/* YES TO EITHER OF THE QUESTIONS ABOVE MEANS IT WILL BE ASPIRATED . . .
 * UNLESS THE PREC PHONEME IS A SIBILANT */
        /* ADD IN A BOUNDARY MARKER (UNDERSCORE) IF A BOUNDARY IS PRESENT,
AND:
         * CUR PHON IS A VOWEL, OR VARIES BY SYLLABLE POSITION */
```

GRDSEL

```
/* THIS FN IS USED TO PRINT COUNTS OF WORDS, MORPHS, ETC. DONE,
 * SUCCESSIVE CALLS PRINT OVER EACH OTHER */
static void printcount ( char *s, int i, int j )
/* READ A FILE WHICH HAS BEEN PROCESSED WITH "PARSNIP";
 * EACH LINE SHOULD HAVE A WORD IN ORTHOGRAPHIC FORM, PLUS A LIST
 * OF UNIT IT CAN BE ASSEMBLED OUT OF; EXTRACT NAMES OF UNITS, & SORT
THEM */
void getunitnames ( char *fn )
    /* READ EACH LINE; SKIP PAST ORTHOGRAPHIC FIELD */
    for ( numwords + wordstrtot = 0;; ++numwords )
    /* WORK THOUGH IT AND IDENTIFY UNIT NAMES (SPACE SEPARATED
    STRING ) */
    for ( cpfrom = line, cpto = s;; ++cpfrom )
/* FIND AND ANALYZE DOUBLE SNIP */
printf ( "finding double snips\n" );
/* INITIALIZE VARIOUS FEATURES OF EACH UNIT, INC. HOW MANY TO GET*/
for ( uc = 0; uc < numunits; ++uc )
/* IF USER USED -1, WRITE A FILE WITH A LIST OF ALL THE UNITS TYPES */
if ( listunitsfn )
/* LOAD THE LEXICON FILE; CREATE A DATABASE OF WORDS AND THEIR
COMPONENT
```

-continued

```
 * UNITS */
void loadlexicon ( char *fn )
    /* GET UNITS. GRAB SPACE-DE.LIMITED STRINGS AS BEFORE */
    for ( w->numunits=hasphraseacc=0, cpfrom = line, cpto = s;; ++cpfrom )
        if( isspace( (int)*cpfrom ) || ! *cpfrom )
        {
            *cpro=0
            if( *s ) {
                /* STORE UNIT INDEX IN WORD'S UNIT ARRAY */
                if ( w->numunits >= WORDMAXUNITS)
                { fprintf (stderr, "too many units in %s; recompile with"
                "bigger WORDMAXUNIT\n", wordlist [numwords].str );
                exit (666); }
/* READ LIST OF WORDS TO AVOID, AND MAKE SURE THEY'RE NOT USED */
void markbadwords (void)
{
        FILE *fp; char badword[1024]; int wc, nummarked = 0;
/* IF USER HAS SPECIFIED A LIST OF WORDS ALREADY COLLECTED,
 * MARK THEM AS USED */
void markalreadygottenwords ( void )
        FILE *fp; char line [1024], word [1024]; int wc, nummarked = 0;
/* WEED OUT UNIT TOKENS IN PHONLOGICALLY PROBLEMATIC ENVIRONMENTS */
void evallex (void )
/* LOOK FOR UNIT TYPES WHICH ARE ONLY FOUND IN SUBOPTIMAL ENVIRONMENTS;
 * UNMARK THE BAD-CONTEXT FLAG OF ALL SUCH UNITS SO THAT SOME ARE PICKED
*/
for (utc = 0; utc < numunits; ++utc )
/* DO THE GREEDY SEARCH FOR AN OPTIMAL WORD LIST */
void dosearch ( void )
/* WRITE A LIST OF WORDS SELECTED, OPTIMALLY (IF - ag USED ), JUST
 * THE ONES WHICH WERE ADDED THIS TIME */
void report ( char *fn, int justnewwords )
        FILE * fp; int wc, uc;
/* COMPUTE THE VALUE OF A WORD'S CONTRIBUTION TO THE UNIT DATABASE */
static int wordvalue (int wn )
/* IF A WORD HAS BEEN SELECTED, CALL THIS FN TO MARK IT AND
 * KEEP TRACK OF ADDED UNITS; WHY SHOULD BE ONE OF THE USEME_CUZ'S */
static int addword( int wc, int why )
/* CHECK THE CONTEXT OF A UNIT; RETURN TRUE IF IT IS SUBOPTIMAL */
static int checkcontext ( int wc, int uc )
/* MAKE A MASTER HEADER FILE master.hdr, WHICH genhdrs CAN USE TO CREATE
 * .hdr FILES FOR ALL THE SNIPS */
void makemasterhdr ( void )
/* FOLLOWING STUFF IF FOR LOOKING UP WORDS EFFICIENTLY;
 * this fn is like strcasecmp, but quits at either end of string of whitespace,
 * i.e., at end of orthographic string (ignore phonemes flwg space */
static int wordstrcmp( char * cp1, char *cp2 )
{
        int c1, c2, diff = 0;
        for( ; ; ++cp1, ++cp2)
/* LOOK FOR WORD WITH ORTH STRING MATCHING s, RETURN INDEX IF
FOUND,
 * OTHERWISE NOVAL; INDEX CREATED WITH qsort ON FIRST CALL */
int lookupword( char *s )
```

While the invention has been described in its presently preferred embodiments, it will be appreciated that modifications can be made to the foregoing techniques without departing from the spirit of the invention as set forth in the appended claims.

From the foregoing, it will be seen that the present invention provides a systematic approach for selecting an optimal set of words and phrases from which sound units, adapted for voice quality, may be generated for a text-to-speech synthesizer. The system provides an optimal solution, in that the time and effort needed to be expended by the human reader is minimized, while the speech synthesized is of a voice quality similar to that of the specific user. Naturally, the list of words and phrases ultimately chosen by the system to adapt the voice quality will depend on the comparison between the new speaker allophones and the initial allophones provided to the parser in the first instance. However, given a sufficiently large corpus of input text, the resulting optimal set of words and phrases will be compact and yet robust to mimic the speech of individuals.

What is claimed is:

1. A voice adaptation system for use with a text-to-speech synthesizer, comprising:

a recorded snippet database having initial snippets;

a comparison snippets set based on speech from a new speaker, wherein the comparison snippets are used to provide a comparison with current snippets;

a comparison module for performing the comparison by comparing the acoustic proximity between each one of said initial snippets and each one of said comparison snippets; and new speaker text for adapting the voice quality of the text-to-speech synthesizer, the new speaker text based on the comparison.

2. The system of claim 1 wherein the new speaker text is characterized as the smallest subset of text representative of the required sound units.

3. The system of claim 1 wherein the new speaker text is produced by greedy selection.

4. The system of claim 1 wherein the comparison snippet set includes allophones.

5. The system of claim 1 further includes a microphone for inputting new speaker text.

6. A voice adaptation system for use with a text-to speech synthesizer, comprising:

a recorded snippet database having initial snippets;

a comparison snippet set based on speech from a new speaker;

required sound units for forming new speaker text;

wherein the required sound units are generated from a comparison of the snippet set with the recorded snippet;

a comparison module for performing the comparison by comparing the acoustic proximity between each one of said initial snippets and each one of said comparison snippets; and text for adapting the recorded snippet database so that synthesized speech has a voice quality of the new speaker, the text provided by an optimal selection algorithm for selecting a limited amount of text representative of the required sound units.

7. The system of claim 6 wherein the initial snippets are replaced with extracted snippets obtained from the text.

8. The system of claim 6 wherein the optimal selection algorithm is greedy selection.

9. The system of claim 6 wherein the comparison snippet set includes allophones.

10. The system of claim 6 further includes a microphone for inputting new speaker text.

11. A method for adapting the voice quality of a text-to-speech synthesizer having a recorded snippet database, comprising:

obtaining a comparison snippets set based on speech from a new speaker;

retrieving initial snippets from the recorded snippet database;

providing required sound units for generating text;

a comparison module for determining the required sound units by comparing the acoustic proximity of each one of said initial snippets and each one of said comparison snippets; and generating text for the new speaker to read, the text is a smallest subset that contains the required sound units.

12. The method of claim 11 wherein the new speaker text is produced by greedy selection.

13. The method of claim 11 wherein the comparison snippet set includes allophones.

14. The method of claim 11 further includes the steps of:

obtaining new speech from the new speaker, the new speech based on the text;

extracting new snippets from the new speech; and modifying the recorded snippet database with the new snippets.

15. The method of claim 14 wherein the initial snippets are based on text optimally selected to represent sound units.

16. A method of constructing a speech synthesizer comprising the steps of:

comparing the acoustic proximity between each one of a set of initial snippets and each one of a set of comparison snippets to generate a corpus labeled recorded speech;

obtaining the corpus labeled recorded speech containing a plurality of allophones in a plurality of contexts;

performing a greedy selection on said corpus to extract a portion of said plurality of allophones based on contextual information;

using said portion of said plurality of allophones to generate synthesis model components of a speech synthesizer.

17. The method of claim 16 further comprising analyzing said plurality of allophones from said portion to construct source-filter model components used to construct said speech synthesizer.

* * * * *